United States Patent [19]

Moreno et al.

[11] Patent Number: 4,709,643

[45] Date of Patent: Dec. 1, 1987

[54] PRIMARY STAGE COMBUSTOR LINING

[75] Inventors: Frederick E. Moreno, Los Altos; Creighton D. Hartman, San Francisco, both of Calif.

[73] Assignee: PruTech II, San Jose, Calif.

[21] Appl. No.: 17,483

[22] Filed: Feb. 24, 1987

[51] Int. Cl.[4] ..... F23M 5/00

[52] U.S. Cl. ..... 110/336; 60/752; 52/506

[58] Field of Search ..... 110/366; 60/752, 753; 52/404, 506; 432/264

[56] References Cited

U.S. PATENT DOCUMENTS

| | | | |
|---|---|---|---|
| 4,130,391 | 12/1978 | Boggum et al. | 110/336 X |
| 4,222,338 | 9/1980 | Adams | 110/336 |
| 4,313,789 | 2/1982 | Frahme | 110/336 X |
| 4,379,382 | 4/1983 | Sauder | 110/336 X |
| 4,637,823 | 1/1987 | Dach | 110/336 X |

*Primary Examiner*—Edward G. Favors

*Attorney, Agent, or Firm*—Harry E. Aine

[57] ABSTRACT

A low $NO_x$ staged combustor for a TEOR steam generator includes a primary combustion chamber lined with an improved refractory lining. The refractory lining includes a first layer of low density ceramic fibrous thermal insulation as of 4" in thickness coated on its hot face with a protective coating of a durable tough material. The ceramic fibers of the insulative layer are oriented normal to the plane of the hot face. In one embodiment, a low density castable refractory thermally insulative layer is sandwiched between the shell of the combustion chamber and the first layer of fibrous insulation. In a second embodiment, a low density thermally insulative ceramic fibrous layer is sandwiched between the shell of the combustion chamber and the first layer of fibrous insulation. In the second embodiment, the ceramic fibrous layers are adhered to the shell by refractory hangers embedded in the fibrous insulation and resistance welded to the shell.

17 Claims, 5 Drawing Figures

PRIMARY STAGE COMBUSTOR LINING

BACKGROUND OF THE INVENTION

The present invention relates in general to low $NO_x$ staged combustors and, more particularly, to such combustors used to generate steam for a thermally enhanced oil recovery (TEOR) process such combustor having an improved primary combustor refractory stage lining.

DESCRIPTION OF THE PRIOR ART

Thermally enhanced oil recovery (TEOR) processes are applied to oil field production in order to extract heavy, viscous, crude oil and tar sands which cannot otherwise be produced. TEOR involves injection of wet steam, which is produced by combusting crude oil in oil field steam generators typically ranging in size from 7 to 15 MW capacity. More than 90% of all oil field steam generators in the United States are located in California, two-thirds (approximately 1,000 units) of which are located in Kern County. Approximately one-third of the produced crude oil is consumed by the steam generator, amounting to over 100,000 barrels of crude oil consumed per day at full capacity. The crude oils which are fired in these steam generators are typically high in nitrogen ($\approx$0.8 to 1.0%) and sulfur content. Uncontrolled emissions of $NO_x$ can, therefore, reach high levels and potentially worsen ambient air quality.

A ceiling on total $NO_x$ emissions from all steam generators in Kern County has been established which limits total emissions to 1979 levels; thus, new generators cannot be brought on-line wihtout reducing emissions from existing ones. If ambient $NO_2$ level in Bakersfield, Calif., exceeds a specified level, the total $NO_x$ ceiling is lowered to 105 ppm $NO_x$, corrected to 3% oxygen if all steamers were in operation.

Emissions of $NO_x$ can be minimized by application of a staged combustion process in which the first or primary combustion stage is thermally isolated and provides long residence time under high temperature, optimally fuel-rich conditions. The combustion products, resulting from the first stage combustion process, are fed into a secondary combustor in which additional air is added to complete the combustion process.

In the primary combustion zone, the combustion products reach a temperature on the order of 2800° to 2900° F., which is sufficiently hot to destroy all but the very high temperature refractory insulation materials.

Heretofore, two primary combustion chamber designs have been proposed for a TEOR system. In a first design, a re-inforced-carbon steel shell 9.5 millimeters thick defines the outer wall of the primary combustion chamber. This shell is thermally insulated from the primary combustion products by a layer of insulation approximately 21" in thickness. The layer of thermal insulation includes a first layer, which faces the hot combustion gases, having a thickness of approximately 20 centimeters and made of a castable, bubble-type alumina refractory operable to 3272° F. This first layer of insulation is carried from a second layer of insulation approximately 23 centimeters in thickness and comprising a refractory insulative castable material having an operating temperature of up to 2552° F. A third and final layer of insulating bricks, approximately 10 centimeters in thickness, interfaces the carbon steel shell to the second insulating layer. The third insulating layer has a maximum operating temperature up to 1832° F.

A major problem with the first design scheme for insulating the primary combustion chamber was that the 21" of thermal insulation allow tremendous thermal stresses to build up in the insulative layers, particularly the castable layers. In addition, it became evident from design calculations that the thick lining of the first design has a very large thermal inertia due to the low thermal conductivity and large mass, and, even though in steady-state, the temperature gradient through the lining is small (hence—low-thermal stress), it is prone to failure due to high stress as developed during heat-up and cool-down.

The second design for the primary combustion chamber calls for double wall shell of stainless steel thermally insulated on its inside by a 15 centimeter thick layer of alumina brick and surrounded on its outside by an annulus developed between the inner shell member and an outer stainless steel shell with the primary combustion air fed through the annulus to the burner. The critial parameters for this design are the air velocity in the annulus and the thermal resistance of the brick lining. Heat is transferred from the combustion gases to the brick lining primarily by radiation. The brick lining conducts heat to the inner shell, which transfers heat to the primary air by convection and to the outer shell by radiation. The outer shell is preferably thermally insulated with a ceramic fiber blanket. Most of the heat radiated to the outer shell is transferred to the primary air by convection and a small amount is lost to the surrounds by conduction. This second design was designated as a "regenerative design".

The regenerative design primary combustor was built and tested and it was discovered that when an attempt was made to turn it down, i.e., to operate at less than full capacity, the primary air flow through the annulus was reduced commensurate with the turn-down which resulted in less cooling and overheating of the shell structure. In addition, upon rapid turn-down, such as that encountered by a catastrophic failure of power or the like, heat stored in the firebrick was radiated back onto the fuel nozzle and the associated structure causing coking and melting, therefore, failure of the fuel nozzle system.

The prior art low $NO_x$ staged combustor for TEOR steam generators is disclosed in an article entitled: "Development of a Low $NO_x$ Burner for Enhanced Oil Recovery" appearing in the proceedings of the 1982 joint symposium on stationary combustion $NO_x$ Control, Vol. 2, published by the United States Environmental Protection Agency at pgs. 45-1 to 45-21. It is also disclosed in the interim report of February 1983 for E.P.A. Contract 68-02-3692 entitled: "Evaluation and Demonstration of Low-$NO_x$ Burner Systems for TEOR Steam Generators" published by the Combustion Research Branch, U.S. Environmental Protection Agency, Research Triangle Park, N.C., 27711.

Thus, it is desired to obtain an improved thermal lining system for the primary combustion chamber of a Low $NO_x$ Staged Combustor for TEOR Steam Generators. It would be desired to substantially reduce the thermal mass of the lining to make it more resistant to thermal shock while being generally immune to deleterious effects of high temperature, corrosion and erosion caused by the hot combustion gas products.

SUMMARY OF THE PRESENT INVENTION

The principal object of the present invention is the provision of a low $NO_x$ staged combustor for TEOR steam generators having an improved primary combustion chamber thermal lining.

In one feature of the present invention, a thermal lining for the primary combustion chamber of the staged combustor includes a first layer of a thermal insulation material comprised of ceramic fibers with the fibrous insulation material having a density falling within the range of 3 to 30 lbs. per cubic foot, and, such fibrous lining being coated on the hot face thereof with a tough, durable refractory material, whereby the thermal energy stored in the thermal insulation is reduced while reducing the weight of the insulative lining and while protecting the fibrous insulative layer from the combustion products.

In another feature of the present invention, the ceramic fibers of the fibrous lining material are made of a refractory material having a preponderance by weight of alumina and silica.

In another feature of the present invention, the fibers of the fibrous lining of thermally insulative material are oriented with their axes of elongation being generally normal to the plane of the coating, whereby the coating wicks into the fibrous lining to form a more durable and erosion-resistant protective coating.

In another feature of the present invention, a second layer of fibrous thermally insulative material is sandwiched between the shell of the primary combustion chamber and the first layer of fibrous insulative material, said second layer being made of blocks of ceramic fibers having a density falling within the range of 3 to 15 lbs. per cubic foot, whereby the thermal mass of the lining is reduced.

In another feature of the present invention, the shell of the primary combustion chamber is made of steel and blocks of ceramic fibrous insulation material are attached to the shell by steel hangers embedded in the blocks of insulation and welded to the steel shell by means of electric-resistance welding.

In another feature of the present invention, the first layer of ceramic fibrous material is made of ceramic fibers comprised of a preponderance by weight of alumina, whereby the operating temperature of the first insulative layer is increased.

In another feature of the present invention, the first and second layers of fibrous insulation material are adhered together by embedding elongated refractory members in the respective first and second layers and mechanically coupling the embedded members together by means of refractory-linking members.

In another feature of the present invention, a second layer of low density castable refractory insulative material is sandwiched between the first layer and the shell of the primary combustion chamber for thermally insulating the shell.

Other features and advantages of the present invention will become apparent upon a perusal of the following specification taken in connection with the accompanying drawings wherein:

DESCRIPTION OF THE PREFERRED EMBODIMENTS

Figure 1:
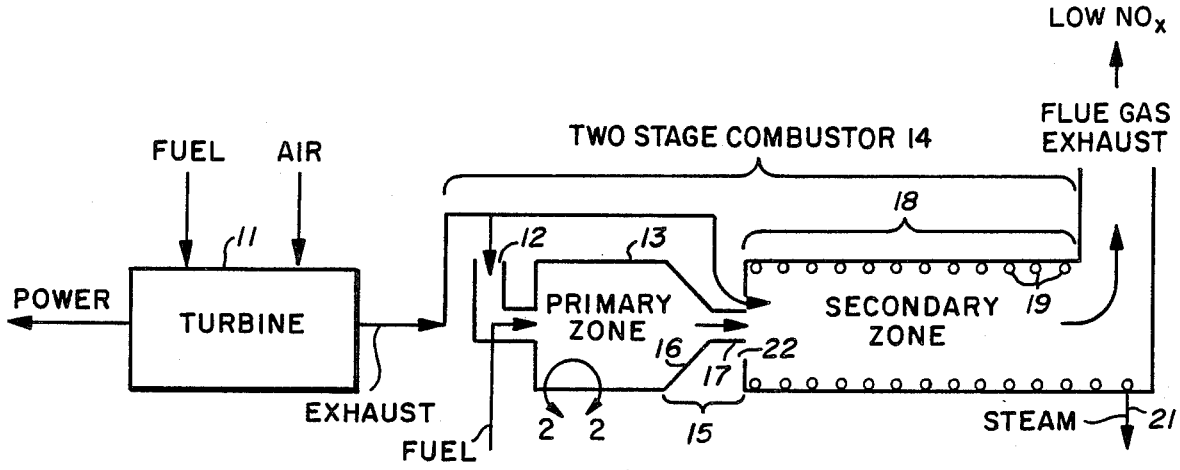
FIG. 1 is a schematic line diagram, partly in block diagram form, of a power and steam generator system for thermally enhanced oil recovery employing features of the present invention.

Referring now to FIG. 1, there is shown a co-generation system employing a two-stage combustor 14 for use in the oil fields for thermally enhanced oil recovery. In this system, a crude oil-fired turbine 11 is coupled to a generator, not shown, for generating electrical power and producing exhaust gases at about 1200° F. containing approximately 15% oxygen. A portion of the exhaust gas is fed into the air intake 12 of a primary combustion chamber 13 of a two-stage combustor 14 wherein the turbine exhaust is mixed with fuel comprising heavy nitrogen-containing crude oil, such as California crude.

Combustion conditions in the primary combustion chamber 13 are arranged so that the fuel and air in the turbine exhaust burn in the primary combustion chamber in a fuel-rich manner, i.e., with 70% or less stoichiometric oxygen. The turbine exhaust is fed into the primary combustion chamber 13 through a plurality of swirl vanes (not shown) arranged for imparting a moderate swirl, having a swirl number falling within the range of 0.3 to 0.5, to the flow of gases in the primary combustion chamber 13. This causes the primary gas stream to expand and to increase its residence time within the primary combustion chamber to approximately 0.5 seconds.

In a typical example, the primary combustion chamber 13 has an inside diameter of approximately 7.5′ and a length of approximately 13.5′ and includes approximately 10″ of refractory insulation material lining the interior walls thereof. The flame temperatures within the primary combustion zone typically reach temperatures of between 2800° and 2900° F.

The hot combustion gases exit the primary combustion chamber 13 through a transition region 15 which includes a constrictor portion 16 which constricts the diameter of the flow stream and the stream, as constricted, then exits through a throat portion 17 into the secondary combustion chamber 18. The secondary combustion chamber 18 includes water boiler pipes 19 lining the interior of the secondary combustion chamber 18 for removing heat from the secondary combustion chamber, primarily by radiation, and for converting the heat into steam which is drawn off at 21.

The remainder of the turbine exhaust is fed, as secondary air, into the entrance to the secondary combustion chamber 18 in a flow pattern coaxially surrounding the outer periphery of the primary gas stream exiting the primary combustion chamber 13 at the exit of the throat portion 17. The secondary air contains approximately 15% oxygen and is at a temperature of approximately 1200° F. and is fed into the secondary combustion chamber 18 through a plurality of ports 22 coaxially of and disposed around the periphery of the throat portion 17.

In a typical example, the flow-constricting portions 16 of the transition 15 has an axial length of approximately 4' and necks the flow down from a diameter of approximately 7.5' to approximately 3', which is the diameter of the throat portion 17. The throat portion 17 has an axial length of between 2' and 3' and the axial velocity of the primary gas stream exiting the primary combustion chamber at the throat 17 is approximately 100' per second.

The turbine exhaust secondary air enters the secondary combustion chamber 18 through 8 ports 22 which typically have a diameter of 8.7" and axial length of approximately 6". The ports 22 are typically provided in a stainless steel plate lined with a refractory insulative material as of 6" in thickness. The ring of secondary air injection ports 22 adds the balance of the combustion air required to complete combustion. The throat region 17 is required to prevent back-mixing of secondary air into the primary zone, and to shape the flame in the secondary zone to prevent flame impingement on the walls of the boiler-radiant zone or secondary zone.

Figure 2:
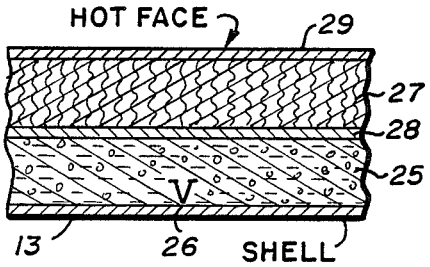
FIG. 2 is an enlarged sectional view of a portion of the structure of FIG. 1 delineated by line 2—2.

Referring now to FIG. 2, there is shown, in cross-section, a thermally insulative lining for the shell 13 of the primary combustion chamber 13. More particularly, the shell 13 is preferably made of mild steel having a thickness as of 0.250". A 6" layer of a low-density castable refractory insulative layer 25 having a density less than 100 lbs. per cubic foot is coated onto the shell 13 and mechanically coupled thereto via the intermediary of an array of v-shaped metallic hangers 26 as of stainless steel affixed to the shell as by welding. The v-shape hangers 26 extend away from the shell 13 by two-thirds to one-half of the thickness of the insulative layer 25. A suitable, castable refractory insulative material 25 is a mixture of alumina, silica and calcium oxide powders comprising 44% by weight alumina, 35% by weight silica and 17% by weight calcium oxide having a density of 65 lbs. per cubic foot; and commercially available from Babcock and Wilcock of Augusta, Ga. under the Trademark KAOLITE 2500-LI. It is applied by spraying it onto the interior surface of the steel shell 13. This material has a continuous maximum temperature use limit of 2500° F.

A 4" thick layer of refractory, ceramic fibrous insulative material 27 is affixed to the interior surface of the first layer of insulation 25 via the intermediary of a refractory cement 28 such as a cement commercially available from Babcock and Wilcock as UNISTIK which is refractory and offers good tackiness and prolonged, high temperature module-to-refractory adhesion.

A suitable ceramic fibrous insulative material 27 is UNIFELT XT veneering modules, available from Babcock and Wilcock of Augusta, Georgia, and comprised of ceramic fibers oriented with their axes of elongation generally perpendicular to the plane of the hot face. These modules 27 are thermally stable in a range of temperatures up to 3000° F. The fibers are comprised, preferably, of a preponderance-by-weight alumina, such as 81.2% $Al_2O_3$ and 18.8% $SiO_2$, with a density of 9 lbs./ft$^3$. Such veneering modules may have a density of 3 to 30 lbs/ft$^3$.

The hot face of the fibrous thermally insulative layer 27 is protected by a tough, durable coating, as of ⅛" thick, which protects the thermally insulative lining material 27 against shrinkage and chemical attack from the hot combustion products. A suitable coating material 29 is a high alumina powdered refractory material in a suitable, organic binder which upon firing to the operating temperature of the combustor, i.e., >2,000° F., volatizes the organic binder leaving behind a residual composition of alumina and silica, such a composition is comprised for example, of 95% alumina and 5% silica and which is slightly flexible at operating temperatures above 2400° F.

The protective layer 29 is applied by spraying to a thickness of 1/16" to ⅛" thick. The coating is particularly adherent to the fibrous refractory layer 27 because the fibers of the layer 27 are oriented with their axes of elongation generally perpendicular to the plane of the coating 29 such that the coating tends to wick down into and form a tight adherence to the outer surface of the fibrous insulative layer 27. A suitable protective coating is commercially available as UNIKOTE S, commercially available from Babcock and Wilcock of Augusta, Ga. and type ZO protective coating commercially available from ZYP Coatings of Oakridge, Tenn., such latter coating being based upon zirconia and being silicon-free.

Figure 3:
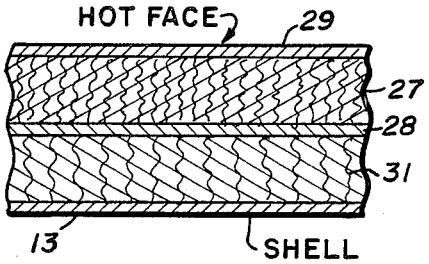
FIG. 3 is a view similar to that of FIG. 2 depicting an alternative embodiment of the present invention.

Referring now to FIG. 3, there is shown an alternative embodiment of the refractory lining system for the shell 13 of the primary combustion chamber. In this embodiment, the structure is essentially the same as that of FIG. 2 with the exception that the castable outer thermally insulative layer 25 of the embodiment of FIG. 2 is replaced by blocks of ceramic insulation material 31 with the fibers generally oriented perpendicular to the plane of the coating 29 and to the plane of the shell 13.

The ceramic fibrous insulation layer 31 is preferably made of blocks of ceramic fibers with the fibers oriented perpendicular to the plane of the coating 29 and to the plane of the shell 13 to reduce erosion and to make the insulative material more durable. The fibrous, insulative layer 31 has a density falling within the range of 3 to 30 lbs. per cubic foot and has a maximum, continuous useful operating temperature of 2600° F. The layer 31 has a thickness of approximately 6". In a typical example, the ceramic fibers are composed of a alumina-silica mix having an alumina composition of between 47–52% by weight and a silica composition falling within the range of 48–53% by weight. The fibers have a typical diameter on the order of 2.8 microns and a length on the order of 4". The melting point of the fibers is on the order of 3200° F.

The blocks of fibrous insulation 31 are held to the steel shell 13 in a manner to be more fully disclosed below with regard to FIG. 5.

Briefly, stainless steel tubes are embedded in the insulative layer 13 and these tubes are held to the shell 13 by means of a generally Y-shaped stainless steel wire structure electrical resistance welded to the shell 13.

The fibrous insulative material 31 is commercially available from Babcock and Wilcock of Augusta, Ga. as KAOWOOL PYRO-LOG fiber.

Figure 4:
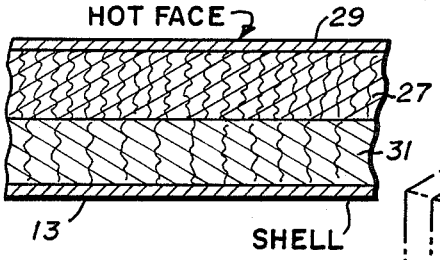
FIG. 4 is a view similar to FIGS. 2 and 3 depicting an alternative embodiment of the present invention.

Referring now to FIG. 4, there is shown an alternative embodiment of the present invention. In the embodiment of FIG. 4, the structure is essentially the same as that of FIG. 3 with the exception that the adhesive layer 28 has been replaced by a hanger system which is shown in greater detail in FIG. 5.

Figure 5:
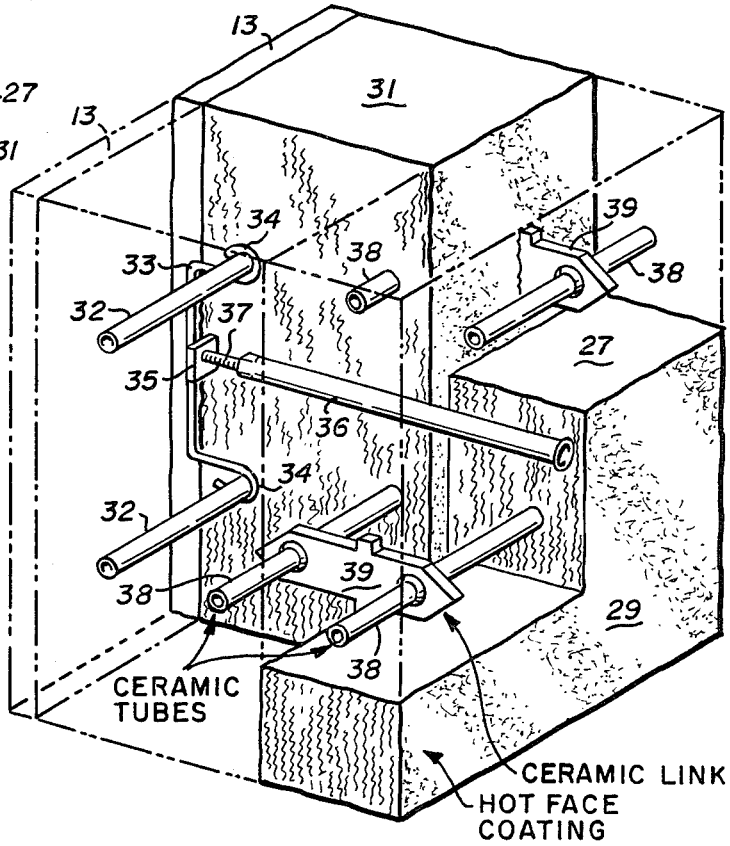
FIG. 5 is a perspective, cut-away view similar to that of FIGS. 2–4 depicting a hanging system for hanging the insulative layers of the embodiment of FIG. 4 to the shell of the primary combustion chamber.

Referring now to FIG. 5, refractory tubes 32, as of stainless steel, are embedded in the fibrous layer 31. Stainless steel wire members 33, generally of Y-shape, include hook portions 34 which hook over the embedded stainless steel tubes 32 and a central portion of the Y member 33 at 35 includes a resistance weld nut which is resistance welded to the steel shell 13. A metal tube 36 is coupled to a threaded stud 37 carried from the weld nut 35. A second nut carried at the inner end of the tube 36 engages the threads of the stud 37. The block of fibrous insulation 31, including the embedded Y-shaped hanging members, is positioned against the shell 13 and an electric welding current is passed through the tube 36, stud 37 and weld nut 35 for welding the weld nut 35 to the inner shell 13. After the welding has been completed, the tube 36 is unscrewed from the stud 37 and removed. The tube 36 extends outwardly from the wall 13 through the thickness of both the ceramic block insulation layer 31 and the veneering insulation layer 27.

The insulation blocks 31 are secured to the veneering insulation layer 27 by means of ceramic tubes 38 embedded in the respective blocks 31 and 27 such ceramic tubes 38 being linked together by apertured ceramic linking members 39.

After the layers 31 and 27 have been affixed to the inside of the shell 13 by the resistance welding technique described above, the hot face of the interior lining material layer 27 is coated, as by spraying, with the refractory coating material 29 described above.

The advantages of the present invention over the prior art first and second designs include: (1) the primary combustion chamber 13 can be raised to operating temperature and cooled down much more rapidly on the order of thirty minutes without incurring thermal damage; (2) the heat stored in the insulative lining is much less thereby minimizing thermal soak-back to the fuel nozzle assembly to avoid damage and coking thereof; (3) the shell structure 13 is simplified in that no separate cooling jacket is required and less heat is lost to the shell allowing cooler operation of the shell; and (4) the thermal lining is of less weight requiring less shell structure to support the weight of the thermal lining and the lining is easier to construct.

What is claimed is:

1. In a method for protecting the shell of a primary combustion chamber of a staged low $NO_x$ burner for a thermally enhanced oil recovery steam generator, the steps of:

lining the interior of the primary combustion chamber of the staged low $NO_x$ burner with a first layer of fibrous, thermally insulative material comprised of ceramic fibers, said first layer of insulation material having a density falling within the range of 3 to 30 lbs. per cubic foot, and lining the interior of said first layer of thermally insulative material with a coating of a tough, durable refractory material, whereby the thermal energy stored in the thermally insulative liner is reduced while reducing the weight of the insulative liner and while protecting the first fibrous insulative layer from the deleterious effects of the combustion processes.

2. The method of claim 1 wherein the ceramic fibers of said first layer of fibrous lining material are made of a refractory material having a preponderance by weight of alumina and silica.

3. The method of claim 1 wherein the fibers of said fibrous insulative lining material are oriented with their axes of elongation being generally normal to the plane of said coating.

4. The method of claim 1 including the step of sandwiching a second layer of fibrous thermally insulative material between the shell of the primary combustion chamber and said first layer of fibrous thermally insulative material, said second layer of fibrous insulative material being made of blocks of ceramic fibers and said blocks of ceramic fibers having a density falling within the range of 3 to 30 lbs. per cubic foot.

5. The method of claim 4 wherein the shell of the primary combustion chamber is made of steel and including the step of:

attaching said blocks of ceramic fibrous material to said steel shell of the primary combustion chamber by electric resistance welding of steel hangers embedded in the blocks of insulative material to the inside wall of the steel shell.

6. The method of claim 4 including the step of adhering said first and second layers of insulation together by means of a layer of refractory cement.

7. The method of claim 1 wherein the ceramic fibers of said first fibrous lining of thermally insulative material are made of a material comprised of a preponderance by weight of alumina.

8. The method of claim 4 including the step of adhering said first and second layers of insulation material together by embedding elongated refractory members in the respective first and second layers of said insulative materials and mechanically coupling the embedded members together by means of refractory linking members embedded in said first and second layers of insulation and passing inbetween and mechanically linking the coupled members together.

9. The method of claim 1 including the step of sandwiching a second layer of thermally insulative material between the shell of the primary combustion chamber and said first layer of fibrous thermally insulative material, and making said second layer of insulative material of a low-density castable refractory material having a density less than 100 lbs. per cubic foot.

10. In a low $NO_x$ staged combustor for a thermally enhanced oil recovery steam generator:

a primary combustion chamber for burning a nitrogen-containing crude oil under fuel-rich conditions;

a secondary combustion chamber means disposed to receive combustion products of and exhausting from said primary combustion chamber and for adding air to said primary combustion products and for completing the combustion thereof and for transferring heat from the combustion products in said secondary combustion chamber means to water-filled pipes for generation of steam for use in a thermally enhanced oil recovery process;

said primary combustion chamber including a primary outer steel shell structure for containing the primary combustion stage;

a thermally insulative lining structure lining the interior of said primary steel shell structure for protecting said shell fro the primary combustion products including heat;

said lining structure including a first layer of a fibrous thermally insulative material comprised of ceramic fibers, said first layer of thermally insulative material having a density within the range of 3 to 30 lbs. per cubic foot; and said lining structure also including a coating on the interior surface of said first layer of fibrous insulation, said coating being made of a tough durable refractory material, whereby the heat stored in said lining structure is reduced while reducing the weight of said lining structure and while protecting said first fibrous layer from the deleterious effects of the combustion processes.

11. The combustor of claim 10 wherein the ceramic fibers of said fibrous lining of thermally insulative material are made of a refractory material having a preponderance by weight of alumina and silica.

12. The combustor of claim 10 including a second layer of fibrous thermally insulative material disposed between said shell of the primary combustion chamber and said first layer of fibrous insulative material, said second layer of fibrous insulative material being made of blocks of ceramic fibers having a density falling within the range of 3 to 30 lbs. per cubic foot.

13. The combustor of claim 10 wherein the fibers of said first fibrous layer of insulative material are oriented with their axes of elongation being generally normal to the plane of said coating.

14. The combustor of claim 12 including hanger means embedded in said blocks of insulation material and welded to said shell of the primary combustion chamber for affixing the blocks of ceramic fibrous insulation to said shell.

15. The combustor of claim 10 wherein the ceramic fibers of said first layer of fibrous thermally insulative material are made of a material comprised of a perponderance by weight of alumina.

16. The combustor of claim 12 including hanger means for adhering said first and second layers of thermally insulative material together, said hanger means including elongated refractory members embedded in said respective first and second layers of refractory material and linking means for mechanically coupling together said embedded members for coupling said first and second layers of insulation material together.

17. The combustor of claim 10 including a second layer of thermally insulative material sandwiched between said shell of the primary combustion chamber and said first layer of fibrous thermally insulative material, said second layer of insulative material being made of a low-density castable refractory material having a density less than 100 lbs. per cubic foot.

* * * * *